US006041690A

United States Patent [19]

Feichtiger et al.

[11] Patent Number: 6,041,690

[45] Date of Patent: Mar. 28, 2000

[54] PNEUMATIC CONTROL UNIT FOR AT LEAST PARTIAL OPENING OF A MOVABLE BODY PART OF A MOTOR VEHICLE

[75] Inventors: Dieter Feichtiger, Aidlingen; Martin Lindmayer, Sulz; Kurt Schaible, Aidlingen, all of Germany

[73] Assignee: Daimler-Benz AG, Stuttgart, Germany

[21] Appl. No.: 09/023,856

[22] Filed: Feb. 13, 1998

[30] Foreign Application Priority Data

Feb. 13, 1997 [DE] Germany ..... 197 05 414

[51] Int. Cl.[7] ..... F15B 11/08

[52] U.S. Cl. ..... 91/422; 92/62; 92/63; 92/113; 92/130 A; 91/432

[58] Field of Search ..... 92/62, 63, 82, 92/109, 110, 111, 112, 113, 114, 115, 130 A; 91/422, 432

[56] References Cited

U.S. PATENT DOCUMENTS

| | | | |
|---|---|---|---|
| 300,401 | 6/1884 | Sjogren | 91/422 X |
| 3,139,008 | 6/1964 | Haanes | 91/422 X |
| 3,152,524 | 10/1964 | Newell | 92/114 X |
| 3,270,626 | 9/1966 | Bradbury | 92/113 |
| 3,555,971 | 1/1971 | Schroder | 91/422 X |
| 3,828,651 | 8/1974 | Dorner et al. | 91/422 X |
| 4,531,451 | 7/1985 | Mouton | 92/110 X |
| 5,301,598 | 4/1994 | Sonnabend | 92/113 X |

FOREIGN PATENT DOCUMENTS

| | | | |
|---|---|---|---|
| 1650634 | 5/1970 | Germany | 91/422 |
| 4427148A1 | 2/1996 | Germany . | |

*Primary Examiner*—John E. Ryznic
*Attorney, Agent, or Firm*—Evenson McKeown Edwards & Lenahan, PLLC

[57] ABSTRACT

A pneumatic drive unit is provided for partially opening a vehicle body part such as a trunk lid. The pneumatic drive unit includes a working chamber which in use applies pressure to move a control member which engages a contact surface of the vehicle body part. A vent channel is provided which selectively connects the working chamber with the atmosphere as a function of the position of a movable closing element of the drive unit element and contact of the control member with the vehicle body part such that when the body part is closed after a partial opening, the drive unit is ready for another control operation.

25 Claims, 1 Drawing Sheet

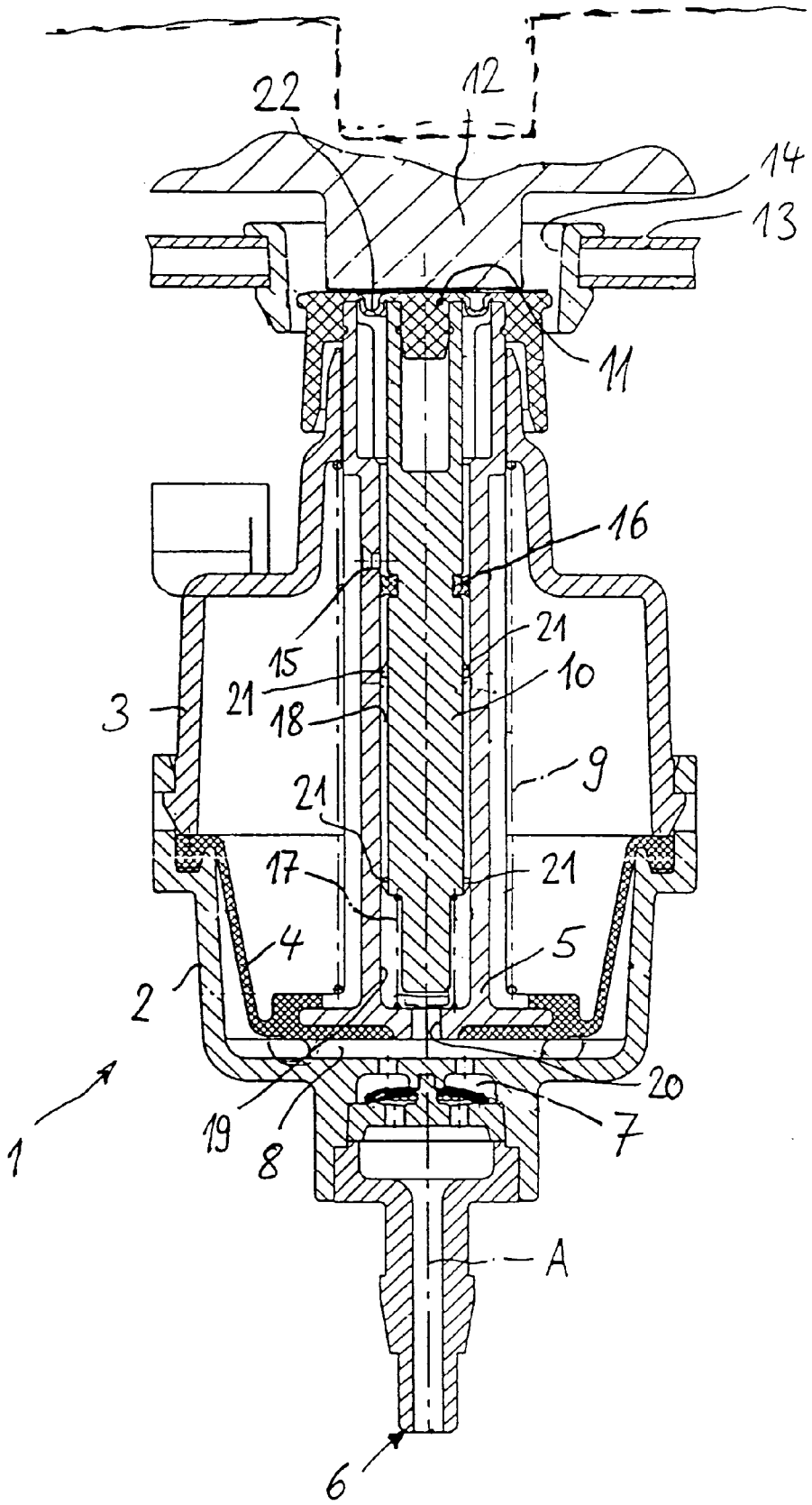
22
12
14
13
11
16
15
21
10
3
21
18
9
21
17
21
4
5
2
20
1
19
8
7
A
6

PNEUMATIC CONTROL UNIT FOR AT LEAST PARTIAL OPENING OF A MOVABLE BODY PART OF A MOTOR VEHICLE

BACKGROUND AND SUMMARY OF THE INVENTION

This application claims the priority of German application 197 05 414.5-14 filed in Germany on Feb. 13, 1997, the disclosure of which is expressly incorporated by reference herein.

The invention relates to a pneumatic control unit for at least partial opening of a movable body part of a motor vehicle, with a control member that is linearly movable along a control axis and projects partially out of a housing, said member being capable of being pressurized by a working chamber provided in the housing, with the free end of said member being provided with a contact surface for abutting the movable body part, with said body part exerting a contact pressure on the contact surface of the control member in a closed resting position.

A pneumatic control unit is known from German Patent Document DE 44 27 148 A1, said unit being provided both for actuating a central locking system and as a pulling aid for pulling a movable body part out of a previously latched position into a closed position. For this purpose the pneumatic control unit has two drive members mounted coaxially with respect to one another, said members being movable separately or jointly by different pressure applications.

A goal of the invention is to use a simple pneumatic device to open the movable body part and to allow a simple return of the control unit to the initial position.

This goal is achieved in accordance with preferred embodiments of the invention by providing a pneumatic drive unit for at least partial opening of a movable body part of a motor vehicle with a control member that is linearly movable along a control axis, said member partially extending out of a housing, said member being capable of being pressurized by means of a working chamber provided in the housing, and with a free end of said member being provided with a contact surface for abutting the movable body part, with the body part, in a closed resting position, exerting a contact pressure on the contact surface of the control member, wherein a vent channel is provided that connects the working chamber with the atmosphere, and wherein a closing element is provided that is loaded by a spring arrangement for closing and opening the vent channel, said closing element being held in its closed position when the body part rests on the contact surface of the control member, and when the body part is removed from the contact surface by the spring force of the spring arrangement can be moved into its open position to open the vent channel.

Embodiments of the invention are advantageous in that a vent channel connecting the working chamber with the atmosphere is provided in the control member, with which channel a closing element for closing and opening said vent channel is associated, said closing element being loaded by a spring arrangement, with the closing element being held in its closed position when the body part abuts the contact surface of the control member, and being movable into its opening position that opens the vent channel when the body part is moved away from the contact surface by the spring force of the spring arrangement.

Pressurizing the working chamber forces the control member out of the housing, so that the movable body part is simultaneously moved out of a closed resting position. Advantageously a rear body part in the form of a trunk lid is provided as the body part, so that opening the body part constitutes lifting the body part. The pneumatic control unit is especially advantageous in conjunction with remote unlocking of the rear body part, since the lifting of the rear body part creates a gap between the edge of the trunk and the lower edge of the rear body part, which makes it readily apparent that the rear body part is in an open position. If the rear body part is not lifted by the control unit, although the rear body part is unlocked, it is possible that the unlocked state of the rear body part will not be detected. The provision of the vent channel in conjunction with the closing element according to the invention permits the control member to be charged with air and thus returned together with the closing element into the initial position, as soon as the body part separates from the contact surface of the control member, in other words in particular as soon as the rear body part is lifted off the contact surface. Such lifting out of the already partially open position of the body part can be accomplished manually or by a gas compression spring or a similar control element.

In an embodiment of the invention, the closing element is designed as a closing piston mounted to be linearly movable coaxially to the control axis in a cavity of the control member that is open to the contact surface, said piston being provided with a seal for sealing the vent channel. This is an especially sturdy and functionally reliable design.

According to another aspect of preferred embodiments of the invention, the closing piston forms an annular chamber with a wall of the cavity, said chamber constituting a part of the vent channel, and the annular chamber is connected by a channel section with the working chamber. As a result, the working chamber is rapidly charged with air and, as a result, the control member is rapidly returned to its initial position.

According to another aspect of preferred embodiments of the invention, the annular chamber has at least one vent opening that projects radially through the wall of the control member, relative to the control axis, and the closing piston has an annular seal that seals off the annular chamber, said seal being located in the closed position of the closing piston on a wall of the annular chamber that faces the working chamber.

According to another aspect of preferred embodiments of the invention, the stroke of the closing piston that is triggered by the spring force of the spring system is dimensioned relative to the control member in such fashion that the annular seal is on a side of the vent opening that faces the contact surface when the closing piston is in the open position. By a simple linear displacement of the closing piston therefore the vent channel is opened for charging the working chamber with air, so that the stroke of the closing piston necessarily takes place together with the lifting of the body part from the contact surface of the control member, so that the closing piston is forced out by means of the spring force of the spring system, partially upward out of the cavity of the control member.

According to another aspect of preferred embodiments of the invention, the working chamber can be shut off by a check valve located between a connecting stub of the housing and the working chamber. As a result, it is possible to trap the pressure for actuating the control member in the working chamber, so that the pressure in the working chamber is maintained even when the rest of the pneumatic system to which the drive unit is connected has already been vented.

According to another aspect of preferred embodiments of the invention, the spring force of the spring arrangement is less than the contact pressure of the body part. Therefore, as soon as the body part is re-closed and comes to rest on the contact surface of the control member, the closing piston is forcibly pushed back into its initial position in which it is recessed in the control member.

According to another aspect of preferred embodiments of the invention, a compression spring is associated with the control member, said spring restoring the control member to the resting position. Therefore, as soon as the working chamber has been vented, this compression spring pushes the control member back into the initial position.

According to another aspect of preferred embodiments of the invention, the contact surface is formed by a contact plug that covers both the control member and the closing piston, said plug also being provided with a compensating sleeve to accept a relative movement between the closing piston and the control member. As a result the extension of the closing piston relative to the control member under the spring force of the spring arrangement is not impeded by the contact plug. The contact plug is preferably made of an elastic material, with the compensating sleeve being made integral with the contact plug. The elastic material prevents a hard impact of the body part against the contact surface.

Other objects, advantages and novel features of the present invention will become apparent from the following detailed description of the invention when considered in conjunction with the accompanying drawings.

BRIEF DESCRIPTION OF THE DRAWINGS

The single drawing FIGURE shows a lengthwise section through one embodiment of a pneumatic drive unit according to the invention, provided for lifting a rear body part of a motor vehicle.

DETAILED DESCRIPTION OF THE DRAWINGS

Pneumatic drive unit 1 has a housing composed of two housing parts 2, 3. An elastic roll membrane 4 is stretched between the two housing parts 2, 3, said membrane delimiting a working chamber 8 inside housing 2, 3, working chamber 8 is connected by a connecting stub 6 in a manner not shown with a pneumatic line of a pneumatic system, said system having a pump for charging the pneumatic line and drive unit 1 with pressure. In a line segment between connecting stub 6 and working chamber 8, a check valve 7 is integrated in housing part 2, said valve allowing pressure to flow from the pneumatic line into working chamber 8 while simultaneously trapping the pressure in working chamber 8.

A control piston 5 serving as a control member is permanently attached to roll membrane 4, with the piston plate of said piston, not described in greater detail, being enclosed by injection of the elastic material of roll membrane 4. Control piston 5 projects through housing 2, 3 and upward partially out of an outlet opening of housing part 3. Housing part 3, in the vicinity of the outlet opening, simultaneously constitutes a linear guide for control piston 5 along a control axis A, as a result of an appropriate design for the wall of the outlet opening, said axis also constituting a central lengthwise axis of housing 2, 3 of drive unit 1. Control piston 5 is provided with a cylindrical cavity 18, 19 which is open to the free end of control piston 5 that abuts roll membrane 4. Cavity 18, 19 is connected with working chamber 8 by a channel segment 20 with a smaller diameter.

A closing piston 10 is guided in a linearly movable fashion in cavity 18, 19, the outside diameter of said piston being smaller than the inside diameter of cavity 18, 19. In order nevertheless to ensure a concentric positioning of closing piston inside cavity 18, 19 and a linear guidance coaxially with respect to control axis A, a plurality of guide pins 21 projecting radially outward is provided on the outer circumference of closing piston 10, said pins abutting the wall of cavity 18, 19 and holding closing piston 10 with no radial play in cavity 18, 19. Closing piston 10 has at least approximately the axial length of cavity 18, 19.

The free, upwardly projecting end of closing piston 10 is provided with a recess into which a contact plug 11 made of an elastic material is inserted. Contact plug 11 has a compensating sleeve 22 that surrounds the end of closing piston 10 externally at the edge, said sleeve being bent with folds and permitting elastic flexibility. Compensating sleeve 22 is an integral part of contact plug 11. Contact plug 11 is extended radially outward by compensating sleeve 22 with an annular packing section that surrounds the end of control piston 5 externally at the edge. Contact plug 11 forms a radial contact surface that is plane relative to control axis A for a projection 12 of a rear body part in the form of a trunk lid of an automobile. The nose-shaped projection 12 of the trunk lid projects into an opening 14 of a loading edge 13 at the rear of the automobile body, with opening 14 being aligned coaxially with control axis A. Of course, control element 1 is secured permanently to the body. The position in which projection 12 projects into opening 14 and abuts the contact surface of contact plug 11 constitutes the closed end position of the trunk lid in which it is secured by a lock.

Closing piston 10 has a radially circumferential annular seal 16 that abuts the wall of cavity 18, 19 and divides the annular chamber formed between the outer jacket of closing piston and the wall of cavity 18, 19 into an upper section and a lower section. In the section of cavity 18 that is the upper section in the drawing, a radial vent bore 15 is provided, said bore projecting into the housing interior of housing part 3 that communicates with the atmosphere. The lower section of cavity 18, 19 is connected with working chamber 8 by the annular chamber as well as by channel segment 20.

Closing piston 10 is also subjected to the pressure of a compression spring 17, said spring fitting around channel segment 20 and abutting a bottom of cavity 18, 19, said spring further exerting a compressive force on closing piston 10, said force acting axially with respect to projection 12. Control piston 5 itself is held in its resting position by a compression spring 9 acting in the opposite direction, said spring 9 abutting at one end against control piston 5 and at the other end against housing part 3 in the vicinity of the outlet opening.

As soon as working chamber 8 has been pressurized through connecting stub 6 by the pump of the pneumatic system, control piston 5 is forced upward against the spring force of compression spring 9, so that the previously unlocked trunk lid is raised into the position indicated by the dashed lines and is thus removed from loading edge 13. Projection 12 also abuts the contact surface of contact plug 11 and thus abuts control member as well as closing piston 10. If the trunk lid is raised manually, the contact pressure of projection 12 on contact plug 11 is eliminated, so that spring arrangement 17 can force closing piston 10 upward. This causes compensating sleeve 22 to stretch so that compensating sleeve 22 and contact plug 11 do not interfere with the linear movement of closing piston 10 relative to control member 5. As a result of this relative movement of closing piston 10 with respect to control piston 5, annular seal 16 is displaced axially past radial vent bore 15 outward into the upper part of cavity 18, so that the vent channel for working chamber 8 formed by vent bore 15, the annular chamber, and the channel segment is opened. The venting of working chamber 8 causes the pressure in working chamber 8 to drop to atmospheric pressure. This permits compression spring 9 to return control piston 5 to the initial position shown in the drawing. As a result, control piston 5 is lowered once more into opening 14. In addition, closing piston 10 which is still in the extended state no longer projects in this position beyond the upper edge of opening 14. As soon as the trunk lid is closed again, extension 12 pushes closing piston 10 back into the initial position shown in the drawing by means of contact plug 11, in which position annular seal 16 is positioned axially below vent bore 15 and thus closes once again the vent channel described above. Drive unit 1 is then ready for another control process.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Pneumatic drive unit for at least partial opening of a movable body part of a motor vehicle with a control member that is linearly movable along a control axis, said member partially extending out of a housing, said member being capable of being pressurized by means of a working chamber provided in the housing, and with a free end of said member being provided with a contact surface for abutting the movable body part, with the body part, in a closed resting position, exerting a contact pressure on the contact surface of the control member, wherein a vent channel is provided that connects the working chamber with the atmosphere, and wherein a closing element is provided that is loaded by a spring arrangement for closing and opening the vent channel, said closing element being held in its closed position when the body part rests on the contact surface of the control member, and when the body part is removed from the contact surface by the spring force of the spring arrangement can be moved into its open position to open the vent channel.

2. Drive unit according to claim 1, wherein the closing element is designed as a closing piston, mounted to be linearly movable coaxially with respect to the control axis in a hollow chamber of the control member that is open to the contact surface, said closing piston being provided with an annular seal to seal the vent channel.

3. Drive unit according to claim 2, wherein the closing piston forms an annular chamber with a wall of the hollow chamber, said annular chamber constituting a portion of the vent channel, and wherein the annular chamber is connected with the working chamber by a channel section.

4. Drive unit according to claim 3, wherein the annular chamber has at least one vent opening that extends radially through the wall of the control member, relative to the control axis, and wherein the closing piston has an annular seal that seals off the annular chamber, said seal, in the closed position of the closing piston, being positioned on a side of the annular chamber that faces the working chamber.

5. Drive unit according to claim 4, wherein the travel of the closing piston, triggered by the spring force of the spring arrangement relative to the control member, is dimensioned so that the annular seal, in the opening position of closing piston, is on a side of vent opening that faces the contact surface.

6. Drive unit according to claim 1, wherein a check valve is provided for blocking pressure fluid flow from the working chamber to a pressure fluid supply connecting stub of the housing.

7. Drive unit according to claim 2, wherein a check valve is provided for blocking pressure fluid flow from the working chamber to a pressure fluid supply connecting stub of the housing.

8. Drive unit according to claim 3, wherein a check valve is provided for blocking pressure fluid flow from the working chamber to a pressure fluid supply connecting stub of the housing.

9. Drive unit according to claim 4, wherein a check valve is provided for blocking pressure fluid flow from the working chamber to a pressure fluid supply connecting stub of the housing.

10. Drive unit according to claim 5, wherein a check valve is provided for blocking pressure fluid flow from the working chamber to a pressure fluid supply connecting stub of the housing.

11. Drive unit according to claim 1, wherein the spring force of the spring arrangement is smaller than the contact pressure of the body part.

12. Drive unit according to claim 3, wherein the spring force of the spring arrangement is smaller than the contact pressure of the body part.

13. Drive unit according to claim 4, wherein the spring force of the spring arrangement is smaller than the contact pressure of the body part.

14. Drive unit according to claim 5, wherein the spring force of the spring arrangement is smaller than the contact pressure of the body part.

15. Drive unit according to claim 6, wherein the spring force of the spring arrangement is smaller than the contact pressure of the body part.

16. Drive unit according to claim 10, wherein the spring force of the spring arrangement is smaller than the contact pressure of the body part.

17. Drive unit according to claim 1, wherein a compression spring that restores the control member to the resting position is associated with the control member.

18. Drive unit according to claim 3, wherein a compression spring that restores the control member to the resting position is associated with the control member.

19. Drive unit according to claim 5, wherein a compression spring that restores the control member to the resting position is associated with the control member.

20. Drive unit according to claim 6, wherein a compression spring that restores the control member to the resting position is associated with the control member.

21. Drive unit according to claim 11, wherein a compression spring that restores the control member to the resting position is associated with the control member.

22. Drive unit according to claim 1, wherein the contact surface is formed by a contact plug, said plug covering both the control member and the closing element, said plug being provided with a compensating sleeve to accept a relative movement between the closing element and the control member.

23. Drive unit according to claim 1, wherein the movable body part is a vehicle trunk lid.

24. A drive unit for partially opening a vehicle body part, comprising:

a working chamber which in use applies pressure to move a control member which engages a contact surface of the vehicle body part, and a vent channel which selectively connects the working chamber with the atmosphere as a function of the position of a movable closing element of the drive unit element and contact of the control member with the vehicle body part such that when the body part is closed after a partial opening, the drive unit is ready for another control operation.

25. A drive unit according to claim 24, wherein the movable body part is a trunk lid.

* * * * *